US010252277B2

(12) United States Patent
Horstkoetter et al.

(10) Patent No.: US 10,252,277 B2
(45) Date of Patent: Apr. 9, 2019

(54) SOLID-BOWL SCREW CENTRIFUGE WITH DISCHARGE CHANNEL INCLINED TOWARD ROTATIONAL AXIS OF CENTRIFUGE

(71) Applicant: GEA Mechanical Equipment GmbH, Oelde (DE)

(72) Inventors: Ludger Horstkoetter, Ennigerloh (DE); Juergen Hermeler, Sassenberg (DE); Stefan Terholsen, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 884 days.

(21) Appl. No.: 14/413,881

(22) PCT Filed: Jul. 5, 2013

(86) PCT No.: PCT/EP2013/064255

§ 371 (c)(1),
(2) Date: Jan. 9, 2015

(87) PCT Pub. No.: WO2014/009272

PCT Pub. Date: Jan. 16, 2014

(65) Prior Publication Data

US 2015/0165449 A1 Jun. 18, 2015

(30) Foreign Application Priority Data

Jul. 11, 2012 (DE) ..... 10 2012 106 226

(51) Int. Cl.
*B04B 1/20* (2006.01)
*B04B 11/02* (2006.01)

(52) U.S. Cl.
CPC ..... *B04B 1/20* (2013.01); *B04B 11/02* (2013.01); *B04B 2001/2075* (2013.01); *B04B 2001/2083* (2013.01)

(58) Field of Classification Search
CPC ..... B04B 1/20; B04B 11/00; B04B 11/02; B04B 2001/2083; B04B 2001/2075
(Continued)

(56) References Cited

U.S. PATENT DOCUMENTS 5,147,277 A 9/1992 Shapiro
7,022,061 B2 * 4/2006 Leung ..... B04B 1/20 494/56

(Continued)

FOREIGN PATENT DOCUMENTS

DE 39 04 151 A1 8/1990
DE 102 03 652 A1 8/2003

(Continued)

OTHER PUBLICATIONS

International Search Report (PCT/ISA/210) dated Sep. 25, 2013 with English-language translation (Four (4) pages).

*Primary Examiner* — Charles Cooley
(74) *Attorney, Agent, or Firm* — Crowell & Moring LLP

(57) ABSTRACT

A solid-bowl screw centrifuge includes one or more discharge weir(s) for discharging clarified liquid out of a drum which has a rotational axis and a rotational direction. The centrifuge has one or more through-opening(s) in a drum cover, each of which is associated with a weir plate having a recess. An open discharge channel is formed on the through-opening at the recess, a deflection from a direction parallel to the rotational direction of the drum substantially into a circumferential direction in the rotational direction being carried out by the discharge channel. The discharge channel is designed such that exiting liquid is conducted over the base of the discharge channel to an overflow edge. The base of the discharge channel to the overflow edge is
(Continued)

Figure 1A:
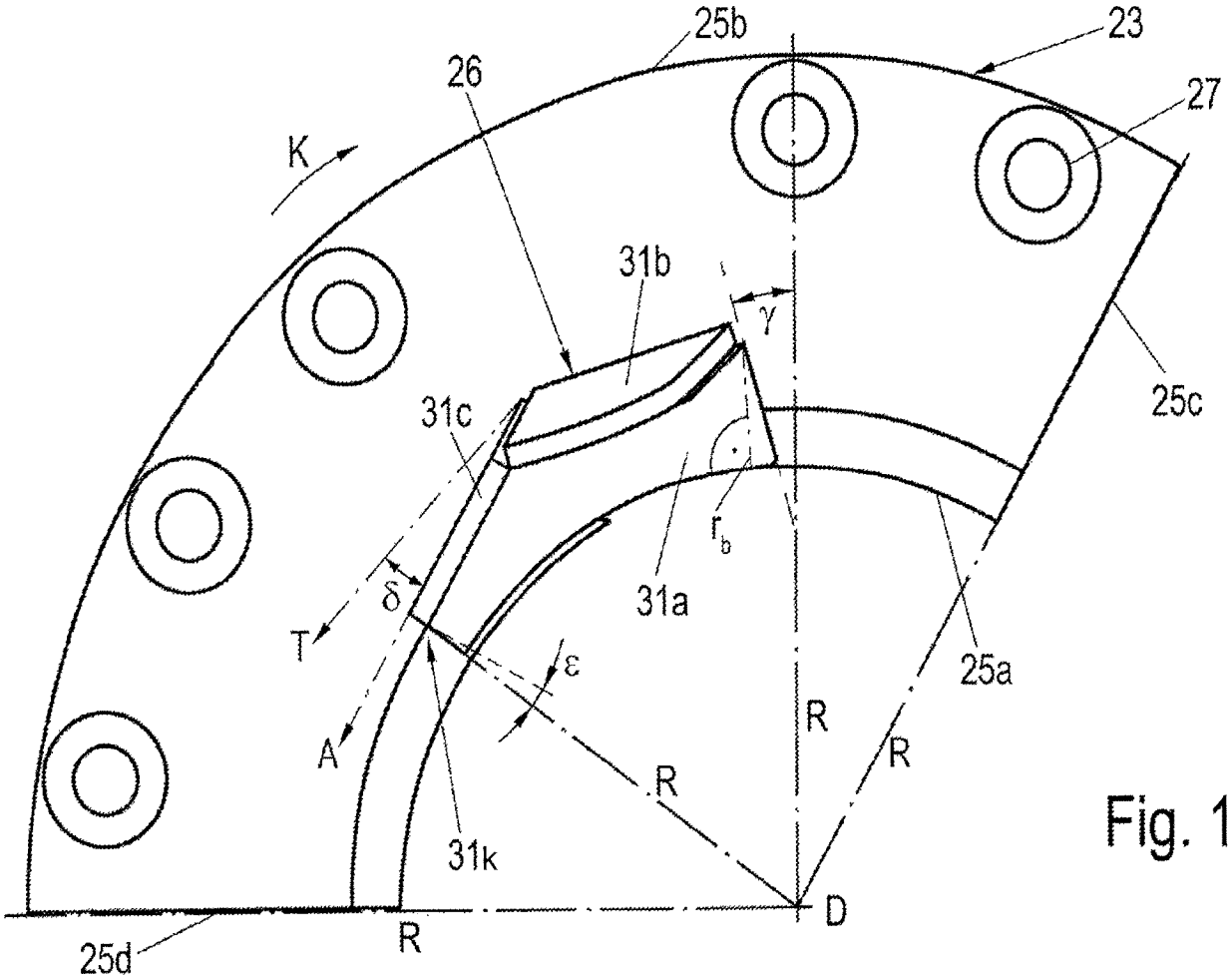

inclined inwards in the rotational direction relative to the tangential direction by an inclination angle $\delta \geq 0$ at the point of the overflow edge.

19 Claims, 4 Drawing Sheets

(58) Field of Classification Search
USPC ..... 494/53, 54, 56, 57; 210/380.1, 380.3
See application file for complete search history.

(56) References Cited

U.S. PATENT DOCUMENTS 8,485,959 B2 * 7/2013 Madsen ..... B04B 1/20 494/53
9,126,208 B2 * 9/2015 Madsen ..... B04B 1/20
9,333,514 B2 * 5/2016 Terholsen ..... B04B 1/20
9,908,125 B2 * 3/2018 Geehan ..... B04B 11/06
9,993,831 B2 * 6/2018 Pasol ..... B04B 1/20
10,105,715 B2 * 10/2018 Schlarb ..... B04B 1/20
10,105,716 B2 * 10/2018 Vielhuber ..... B04B 1/20
2004/0072667 A1 * 4/2004 Leung ..... B04B 1/20 494/56
2004/0072668 A1 * 4/2004 Leung ..... B04B 1/20 494/56
2005/0164861 A1 7/2005 Bruning et al.
2013/0274084 A1 * 10/2013 Madsen ..... B04B 1/20 494/60
2014/0051565 A1 2/2014 Terholsen et al.
2014/0235423 A1 * 8/2014 Pasol ..... B04B 1/20 494/56
2015/0165449 A1 * 6/2015 Horstkoetter ..... B04B 1/20 494/53
2015/0273482 A1 * 10/2015 Bauer ..... B04B 1/20 494/43
2016/0067718 A1 * 3/2016 Schlarb ..... B04B 1/20 494/50

FOREIGN PATENT DOCUMENTS

DE 10 2010 032 503 A1 2/2012
DE 10 2010 061 563 A1 6/2012
JP 11-179236 A 7/1999
WO WO 2008/138345 A1 11/2008
WO WO 2013017223 A1 * 2/2013 ..... B04B 1/20

* cited by examiner

SOLID-BOWL SCREW CENTRIFUGE WITH DISCHARGE CHANNEL INCLINED TOWARD ROTATIONAL AXIS OF CENTRIFUGE

BACKGROUND AND SUMMARY OF THE INVENTION

Exemplary embodiments of the invention relate to a solid-bowl screw centrifuge.

Solid-bowl screw centrifuges are known in the most diverse embodiments.

For example, German patent document DE 102 03 652 B4 discloses a solid-bowl screw centrifuge with a device for discharging clarified liquid from a drum having a cover with an outlet with which is associated a throttling device, in particular a restrictor plate, the distance of which from the outlet is variable. The outlet furthermore has nozzles for discharge of the clarified liquid which, for saving energy, are correspondingly oriented—especially tangentially—in the circumferential direction.

Nozzles on solid-bowl screw centrifuges and their effect of energy saving in the case of a corresponding orientation at an angle to the drum axis are also known from German patent document DE 39 04 151 A1.

The publication "Patent Abstracts of Japan", number 11179236 A, in contrast discloses that guide plates can be associated with outlet ports in the drum cover, which are partially closed off in each case by a weir plate forming an overflow weir, which guide plates impart a swirl to the liquid discharging from the drum, wherein the repelling effect that occurs is to be utilized for saving energy. The guide plates are attached on the outer side of the overflow weir, for example on the weir plates. The guide plates are designed as flat plates, for example, which are oriented parallel to the rotational axis of the drum, wherein the plane in which the flat planes lie do not intersect the drum axis and, for example, include an angle of about 45° with the radially extending straight line which extends in each case through the rotational axis of the drum and the respective outlet port.

It is also known—for example from US patent document US 2004/0072668 A1 or PCT International patent document WO 2008/138345 A1—to arrange a housing instead of an overflow weir on the weir plate of the outlet port, wherein the overflow weir or a nozzle is then formed at the outlet port in an inclined side of the housing. These constructions, however, have the disadvantage that co-rotating, relatively complexly formed liquid chambers, which form a part of the rotating system, are formed on the outer side of the drum cover, so that the clarification or separation process continues in the liquid chambers. Undesirable deposits from this separation process can result in the chambers, which involve cleaning problems and out-of-balance problems.

For this reason, German patent documents DE 10 2010 032 503 A1 and DE 10 2010061 563 A1 turn away from the last-described method.

According to German patent document DE 10 2010 032 503 A1, the overflow weir is left directly on the weir plates on the drum cover and the liquid, which has already vacated the rotating system via the overflow weir, is only deflected in the circumferential direction. After discharge from the drum, a clarification effect can no longer occur, the entire discharging liquid jet being deflected through the deflection device in the circumferential direction instead.

According to German patent document DE 10 2010061 563 A1, the weir plate has a material recess forming at least a part of a discharge channel or a complete discharge channel, wherein the discharge channel is designed in such a way that it deflects in a suitable manner flow discharging from the drum.

Consequently, the two embodiments just discussed have proved to be successful. Nevertheless, there is a further demand for optimization, especially with regard to a good energy recovery with simultaneous assurance of a low tendency toward contamination. Exemplary embodiments of the present invention are directed to addressing this problem.

According to exemplary embodiments of the present invention the bottom of the discharge channel is inclined inwardly toward the rotational axis toward the overflow edge relative to the tangential direction by an inclination angle δ at the location of the overflow edge.

A main advantage of this embodiment is again that product deposits cannot easily form, as in the case of the housings in the manner of PCT International patent document WO 2008/138345 A1. Rather, the open design of the discharge channels avoids this disadvantage. In this case, the constructional embodiment is simple and stable. Moreover, the discharging product flow is deflected onto a radial diameter so that a particularly large saving of energy ensues.

Preferably, $\delta>0°$ and $\delta<25°$, especially $\delta\geq10°$ and $\delta\leq20°$, apply to the angle δ in this case since a particularly advantageously outflow behavior can be achieved in such a way.

BRIEF DESCRIPTION OF THE DRAWING FIGURES

Figure 1B:
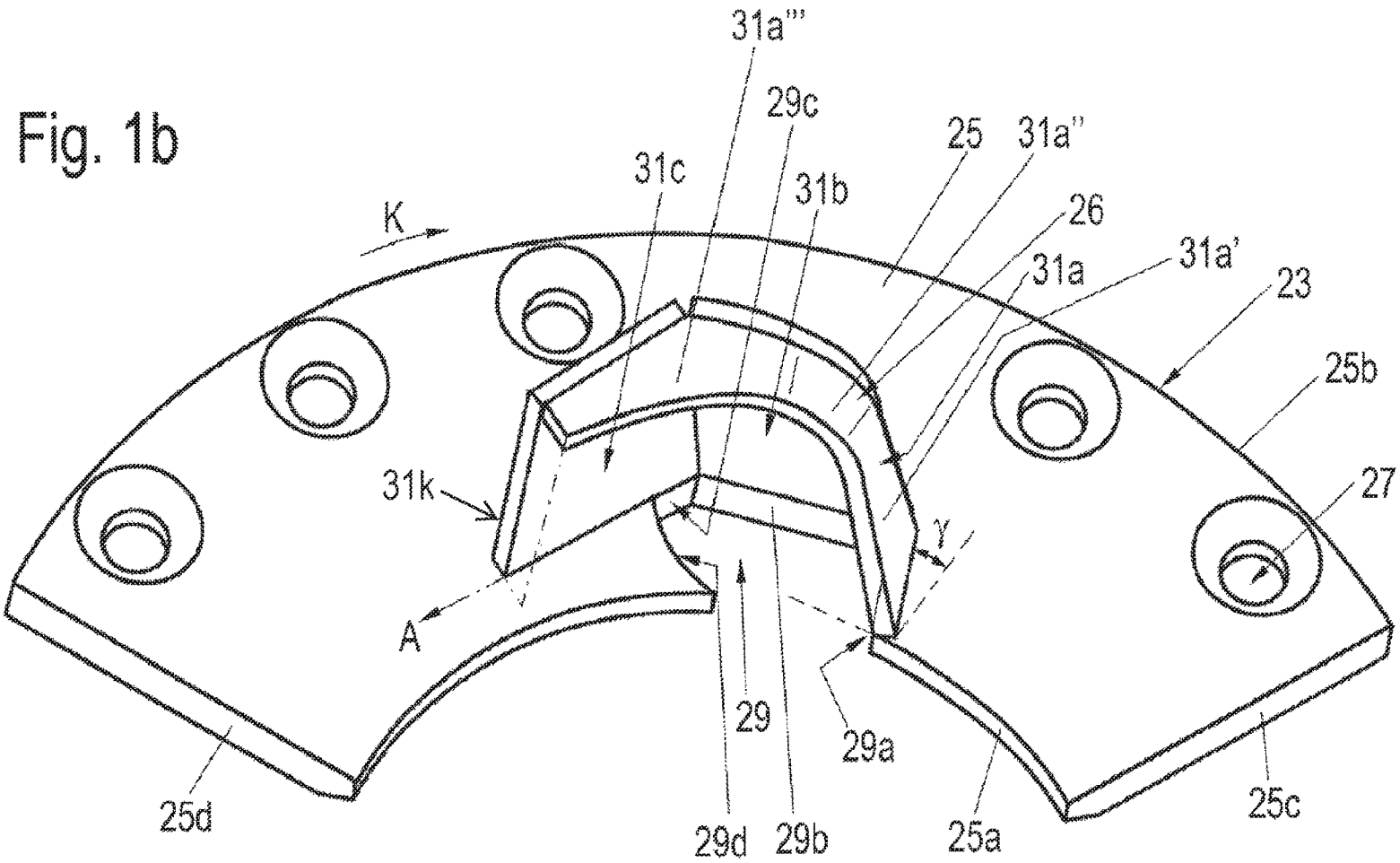
Figure 1C:
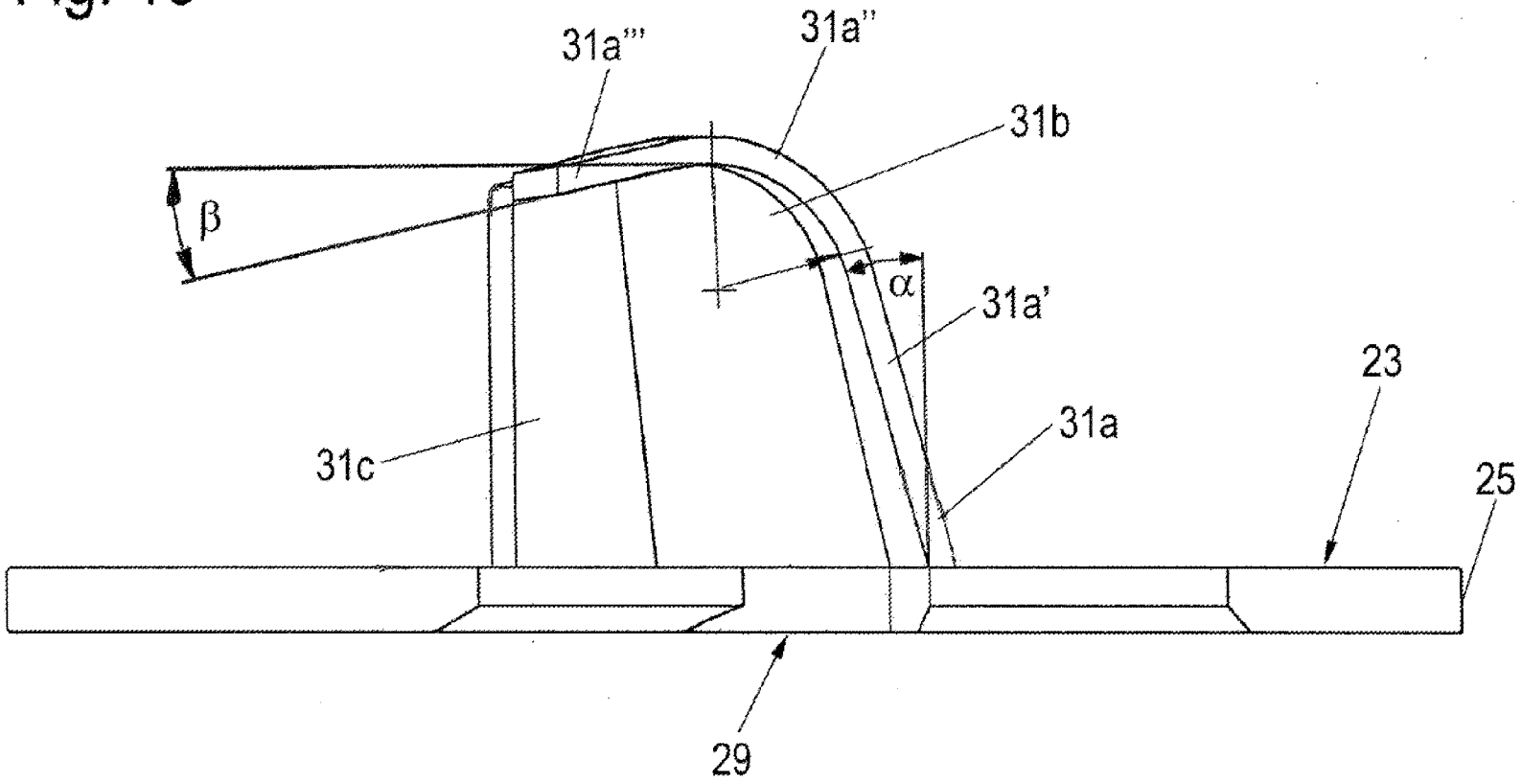
Figure 2:
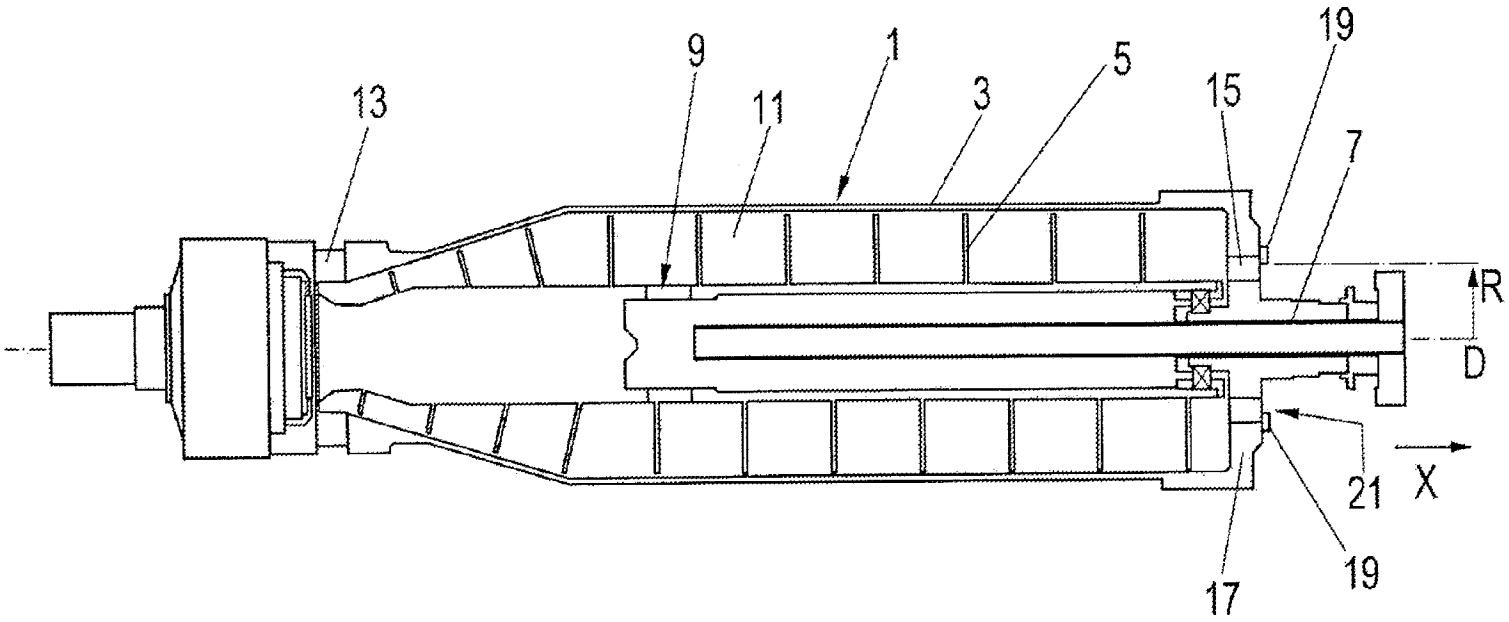
PRIOR ART Fig. 2

The invention is described in more detail below with reference to the drawing. In the drawing:

FIGS. 1*a-c* show different views of a segment of a schematically represented drum cover of a solid-bowl screw centrifuge according to the invention; and FIG. 2 shows a schematic view of a known solid-bowl screw centrifuge.

DETAILED DESCRIPTION

FIG. 2 illustrates the basic construction of a solid-bowl screw centrifuge. The drive along with the control unit, a hood and further elements, which are understood by the person skilled in the art as being part of such a centrifuge, are not shown here.

FIG. 2 shows a solid-bowl screw centrifuge 1 with a drum 3, which is rotatable around a rotational axis D and in which is arranged a similarly rotatable screw 5. Radial directions perpendicular to the rotation axis D are identified by "R".

The drum 3 and the screw 5 each have an essentially cylindrical section and a section that tapers in a conical manner.

An axially extending central inlet pipe 7 feeds the material to be centrifuged, via a distributor 9, into the centrifuging chamber 11 between the screw 5 and the drum 3.

If, for example, a turbid slurry is directed into the centrifuge, coarse solid particles are deposited on the drum wall. A liquid phase is formed more toward the inside.

The screw 5 preferably rotates at a slightly lower or higher speed than the drum 3 and conveys the centrifuged solid material toward the conical section out of the drum 3 to the solid material outlet 13. The liquid in contrast flows toward the larger drum diameter at the rear end of the cylindrical section of the drum 3 and is diverted there over a weir having outlet ports 15 in a drum cover 17, wherein a weir plate 19, which is attached on the outer side of the drum cover in a radially adjustable manner in this case, is associated with each outlet port 15. The inner radial edge of the weir plate 19 therefore defines an overflow edge and consequently also the actual weir or the actual overflow weir 21. The liquid flows out of the drum at the overflow weir 21, which rotates in the circumferential direction with the drum 1 so that the liquid, which flows in the direction X parallel to the rotational axis D over the overflow weir 21, in addition to the axial velocity component as a result of the discharging from the drum, in particular also has a velocity in the circumferential direction (perpendicular to the image plane of FIGS. 1*a-c*, see also FIG. 2) and also a radial component, brought about as a result of centrifugal force, in the outward direction from the center of rotation.

According to the invention, e.g., in the case of a solid-bowl screw centrifuge in the manner of FIG. 2, the drum cover can be provided with discharge weirs 23 in the manner of FIGS. 1*a-c* which replace the weir plates 19, especially in order to achieve a saving of energy.

The discharge weirs 23 again have in each case a flange-like weir plate 25 arranged on the drum cover. In this case, the weir plates 25 are provided with holes 27 for fastening on the drum cover 17 in order to screw down the respective weir plate on the drum cover 17 by means of bolts (not shown here). This fastening is simple and preferred. However, other types of fastening of the weir plate(s) 25 on the drum cover are also conceivable.

According to FIGS. 1*a-c*, the weir plate 25 is designed as a ring segment, wherein it is advantageous (but not absolutely necessary)—especially in order to avoid a slight play by avoidance of gaps or the like—if the ring segments are in direct or very close abutment in the circumferential direction and in such a way form an encompassing ring of weir plates 25. The weir plate(s) 25 can also have another shape, however, e.g. a rectangular or a semi-circular shape.

FIGS. 1*a-c* only show one of the discharge weirs 23.

Each weir plate 25, as a basis of the discharge weir—with regard to the rotational axis D—has an arc section-like inner edge 25*a* and an outer edge 25*b* and also two circumferential edges 25*c* and 25*d*, which here are oriented radially to the rotational axis D. This embodiment is also advantageous since an encompassing ring can easily be formed but is not compulsory.

Formed in the inner edge 25*a*—see especially FIG. 1*b*—is a recess 29 extending outwardly from the inner edge 25*a* with regard to the installed state on the drum cover 17 and terminates radially just before the outer edge 25*b*.

According to FIGS. 1*a* and *b*, the recess 29 has a first edge section 29*a*, which extends preferably radially or at a small angle relative to the radial (angle $\gamma$ is preferably smaller than) 25°), and a second edge section 29*b* oriented preferably perpendicularly, or in the main perpendicularly, to the first edge section 29*a* and which preferably extends tangentially, or in the main tangentially (angle in relation to the tangential direction is 0° or smaller than 20°), to an imaginary circle with a radius $r_b$ to the rotational axis D.

At least the edge section 29*b* preferably aligns with a corresponding port, lying beneath the weir plate 25, in the actual drum cover (not shown here; but see FIGS. 1*a-c*). The edge section 29*b* essentially forms the overflow edge via which liquid discharges axially from the drum.

Adjoining the side of the second edge section 29*b* facing away from the first edge section 29*a* is preferably a (third) edge section 29*c* adjoining at an obtuse angle relative to the second edge section, and adjoining this (third) edge section is preferably a fourth edge section 29*d*, which in this case is in the shape of an arc and connects the third edge section to the arc-shaped inner edge 25*a* of the weir plate 25. The outflow behavior at this recess has proved to be advantageous.

On the outer side of the weir plate 25 facing away from the drum cover in the installed state, a discharge channel is also formed at the recess 29 and is open in the radially inward direction (in relation to the rotational axis) and has a bottom and two side walls, of which one is formed from a guide plate piece 31*a* and one formed by a part of the weir plate 25 itself.

The guide plate section 31*a* and also two guide plate pieces 31*b, c*, forming the bottom, together serve, in conjunction with the weir plate 25, for deflecting a liquid flow, discharging axially from the drum through the recess 29, essentially against the direction of rotation K in the direction −K, which as a result of the additional driving effect in the circumferential direction produced by the deflection leads to a favorable operation from the energy point of view.

The guide plate pieces 31*a, b* and/or *c* can also be formed as sections of a single superordinate and correspondingly correctly bent or cast guide plate, or can be interconnected, for example by welding.

As already explained, the three guide plate pieces 31*a, b, c* and the weir plate 25 itself together form the discharge channel which is open toward the rotational axis D.

The first guide plate piece 31*a* is preferably formed at right angles to the second and to the third guide plate piece 31*b, c*. It forms not only the side wall of the discharge channel but also ensures the actual deflection of the liquid jet from the axial direction X into a circumferential direction −K that is perpendicular thereto.

The first guide plate piece 31*a*, as a side wall of the discharge channel, directly adjoins the first edge section 29*a* of the recess 29 by its side or surface facing the drum.

The first guide plate piece in a preferred embodiment is not arranged here perpendicularly to the weir plate or to the drum cover thereunder but at an acute angle, wherein the angle $\alpha$ between the plane of the weir plate 25 as a base plate and the first guide plate piece 31*a* should preferably be 0° or greater than 0° and smaller than 45°, preferably smaller than or equal to 15° (see FIG. 1*c*). The reference edge for the angle $\alpha$ is perpendicular to the weir plate and is measured on the inner edge of the guide plate piece and of the weir plate.

As a result of this, a first deflection of the liquid from the axial direction into the circumferential direction is no longer achieved. Therefore, the first guide plate piece 31*a* has the radius or the bend 31*a*" and then extends in the section 31*a*'" preferably parallel or preferably at a slight angle toward the weir plate. The angle $\beta$, to which $\beta>0°$ and $\beta<30°$, especially $\beta<20°$, applies, is preferably formed in this case between the plane of the weir plate 25 and the plane in which the flat section 31*a*'" lies or into which the bend of the first guide plate piece (31*a*) extends.

The guide plate piece 31*a* can therefore also again have a plurality of sections or even individual pieces or components. Evident from FIG. 1*c* is that the guide plate piece in this case has a flat section 31*a*' a radius 31*a*" and a flat section 31*a*'" adjoining the radius. Especially significant is the radius since it principally effects the deflection so that the first guide plate piece could be reduced even to a radius or curved section.

As explained already, the first guide plate piece 31*a*, as a side wall of the discharge channel, also adjoins the second and the third guide plate piece 31*b, c* forming the bottom of the discharge channel.

The second and the third guide plate piece 31*b, c* are preferably oriented perpendicularly, or in the main perpendicularly (angle between 90° and 110°), to the plane of the drum cover or the weir plate 25 (which lies perpendicularly to the rotational axis) and arranged on the outer side of the weir plate 25 (in the installed position on the drum) and preferably in a material-bonding manner (e.g. fastened by welding).

The second guide plate piece 31*b* in this case preferably aligns with the second edge section 29*b*. The third guide plate piece 31*c* aligns with the third edge section 29*c*, but is longer than the third edge section 29*c* and ensures a deflection of the discharging liquid jet from the tangential direction, preferably slightly inward toward the rotational axis. The corresponding angle δ between the tangential direction T, where the curved outer edge 25*b* of weir plate 25, as can been seen in FIG. 1*a*, defines the tangential direction T shown in FIG. 1*a*, and the outflow direction A from the bottom of the discharge channel in this case from the third guide plate piece 31*c* toward the rotational axis is preferably larger than 0° and smaller than 25°.

The guide plate pieces can be sections of one plate or separate plate elements. They can also again consist of a plurality of sub-segments or pieces in each case or be divided into such.

The principle of operation of the drain channel shall once more be explained in more detail below.

Liquid discharging from the drum is deflected by the first guide plate piece 31*a* in the circumferential direction of the drum and against the rotational direction K of the drum. Preferably, even a deflection by an angle γ of between 0° and at most 25° relative to the radial direction R, oriented slightly toward the base plate or toward the subjacent drum cover, is carried out, which in a positive manner further reduces the blockage tendency.

An angle ε of the overflow edge can be 0° to the radial R or up to ±10°, preferably ±5°.

In this case, the bottom—formed here from the second and the third guide plate pieces 31*b, c*—of the inwardly open discharge channel prevents the deflected liquid from being sprayed in the outward direction. Instead, the bottom ensures a continuation of the liquid jet in the circumferential direction right to the end of the bottom of the discharge channel where the liquid jet leaves the discharge channel in the direction A at the outflow edge/overflow edge 31*k*.

The liquid jet, deflected in the circumferential direction, is directed slightly inward by the bottom of the discharge channel—in this case by the second guide plate piece 31*b*—first of all essentially tangentially and then by the third guide plate piece 31*c*, oriented at an obtuse angle thereto, is directed from the tangential direction T even toward the rotational axis and leaves the third guide plate piece 31*c* in the direction defined by the orientation of this guide plate piece 31*c*, as a result of which the energy gain is especially large.

A single discharge channel and a single recess 29 are preferably formed on each weir plate. However, a plurality of discharge channels and recesses 29 can also be formed on a single weir plate.

The term guide plate piece 31 is not to be understood too narrowly. This preferably consists in each case of a section of a metal plate. In the sense of this application, however, "guide plate pieces" consisting of non-metallic materials are also conceivable, providing these are suitable for being able to fulfill the necessary deflecting and directing function for the liquid.

Also to be referred to as being very advantageous is that the area of the recess 29 up to the inner edge 25*a* of the weir plate 25 should preferably be smaller, especially by 25% or more smaller, preferably 30% smaller, than the imaginary cross section—the imaginary cross-sectional area—of the discharge channel in the region of the overflow edge (which in the main can be calculated as the product of the width of the bottom by the height of the discharge channel) which is defined by the height of the guide plate piece 31*a* in the region of the overflow edge 31*k*. In this case, the area or the cross section of the recess 29 should preferably be equal to or larger than the fictive imaginary cross section of the discharge channel at the overflow edge since in such a way a once again excellent outflow behavior ensues.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF DESIGNATIONS

Solid-bowl screw centrifuge 1
Drum 3
Screw 5
Inlet pipe 7
Distributor 9
Centrifuging chamber 11
Solid-material outlet 13
Outlet ports 15
Drum cover 17
Weir plate 19
Discharge weir 21
Discharge weirs 23
Weir plate 25
Inner edge 25*a*
Outer edge 25*b*
Circumferential edges 25*c*, 25*d*
Holes 27
Recess 29
Edge sections 29*a, b, c, d*
Rotational axis D
Radius $r_b$
Guide elements 31*a, b, c*
Edge 31*k*
Direction of rotation K
Axial direction X
Angle α, β, γ, δ
Radius $r_b$
Radial direction R

The invention claimed is:

1. A solid-bowl screw centrifuge, comprising:

one or more discharge weirs configured to discharge clarified liquid out of a drum of the centrifuge having a rotational axis and a direction of rotation;

a drum cover having an outlet port;

a weir plate, having a recess, being associated with the outlet port;

an outer edge of the weir plate defining a tangential direction;

an open discharge channel formed at an outlet opening of the recess, wherein the open discharge channel is configured to deflect clarified liquid from a direction parallel to the rotational axis of the drum essentially into a circumferential direction opposite the direction of rotation, wherein the open discharge channel is configured in such a way that discharging liquid is directed via a bottom of the discharge channel up to an overflow edge of the discharge channel, and wherein a portion of the bottom of the discharge channel is inclined inwardly toward the rotational axis toward the overflow edge relative to the tangential direction by an inclination angle $\delta \geq 0$ at a location of the overflow edge.

2. The solid-bowl screw centrifuge of claim 1, wherein the inclination angle $\delta$ is between 10° and 25°.

3. The solid-bowl screw centrifuge of claim 1, wherein the inclination angle $\delta$ is $\geq 10°$ and $\leq 20°$.

4. The solid-bowl screw centrifuge of claim 1, wherein the bottom of the discharge channel is formed from one or more guide plate pieces.

5. The solid-bowl screw centrifuge of claim 4, wherein side walls of the discharge channel are formed from an additional guide plate piece and the weir plate.

6. The solid-bowl screw centrifuge of claim 5, wherein the additional guide plate piece has an arc shape or at least one arc-shaped section.

7. The solid-bowl screw centrifuge of claim 6, wherein the additional guide plate piece also has one or two flat sections.

8. The solid-bowl screw centrifuge of claim 5, wherein the additional guide plate piece is formed in one piece or in a multiple of pieces.

9. The solid-bowl screw centrifuge of claim 8, wherein the one or more guide plate pieces and the additional guide plate piece are formed from a single plate element.

10. The solid-bowl screw centrifuge of claim 5, wherein the one or more guide plate pieces and the additional guide plate piece are welded together.

11. The solid-bowl screw centrifuge of claim 5, wherein the additional guide plate piece, by its side or surface facing the drum, directly adjoins a first edge section of the recess and an angle $\alpha$ between a plane of the weir plate and the additional guide plate piece is between 5° and 25°.

12. The solid-bowl screw centrifuge of claim 5, wherein an angle $\beta$ between 0° and 30° is formed between a plane of the weir plate and a plane into which a bend of the additional guide plate piece extends.

13. The solid-bowl screw centrifuge of claim 4, wherein the one or more guide plate pieces include a second guide plate piece that is oriented perpendicularly or mainly perpendicularly to the weir plate and tangentially or mainly tangentially to a circumferential direction.

14. The solid-bowl screw centrifuge of claim 4, wherein the one or more guide plate pieces include second and third guide plate pieces that align totally or partially with corresponding edges of the recess in the weir plate.

15. The solid-bowl screw centrifuge of claim 1, wherein the recess in the weir plate has one or more straight edge sections.

16. The solid-bowl screw centrifuge of claim 1, wherein the recess in the weir plate has, at least in certain sections, at least one curved arc-shaped edge section.

17. The solid-bowl screw centrifuge of claim 1, wherein a cross-sectional area of the recess up to an inner edge of the weir plate is smaller than an imaginary cross-section of the discharge channel in a region of the overflow edge.

18. The solid-bowl screw centrifuge of claim 17, wherein the cross-sectional area of the recess up to the inner edge of the weir plate is more than 25% smaller than the imaginary cross-section of the discharge channel in the region of the overflow edge.

19. The solid-bowl screw centrifuge of claim 17, wherein the cross-sectional area of the recess up to the inner edge of the weir plate is more than 30% smaller than the imaginary cross section of the discharge channel in the region of the overflow edge.

* * * * *